US011473350B2

(12) United States Patent
Williams et al.

(10) Patent No.: US 11,473,350 B2
(45) Date of Patent: Oct. 18, 2022

(54) VEHICLE HOOD LOCKING MECHANISM

(71) Applicant: Toyota Motor Engineering & Manufacturing North America, Inc., Plano, TX (US)

(72) Inventors: Paxton S. Williams, Milan, MI (US); Scott Louis Frederick, Brighton, MI (US); James D. Cunningham, Clarkston, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 325 days.

(21) Appl. No.: 16/728,155

(22) Filed: Dec. 27, 2019

(65) Prior Publication Data

US 2021/0198927 A1 Jul. 1, 2021

(51) Int. Cl.

| | |
|---|---|
| ***E05C 3/00*** | (2006.01) |
| ***E05C 3/14*** | (2006.01) |
| ***E05F 5/02*** | (2006.01) |

(52) U.S. Cl.

CPC ..... *E05C 3/004* (2013.01); *E05C 3/145* (2013.01); *E05F 5/022* (2013.01); *E05Y 2900/536* (2013.01)

(58) Field of Classification Search

CPC ..... E05C 3/004; E05C 3/145; E05F 5/022; E05Y 2900/536; Y10S 292/14; Y10T 403/7005; Y10T 7/7007; Y10T 292/1043; Y10T 292/4078; Y10T 292/1047; Y10T 292/1051; Y10T 292/1052; Y10T 1/65; Y10T 1/0863; Y10T 1/0864

See application file for complete search history.

(56) References Cited

U.S. PATENT DOCUMENTS

| | | | | |
|---|---|---|---|---|
| 3,505,840 | A * | 4/1970 | Forster | E05B 83/24 70/286 |
| 4,489,967 | A * | 12/1984 | Matsui | E05C 17/14 292/339 |
| 5,238,213 | A * | 8/1993 | Pool | E05C 17/047 248/352 |
| 2007/0194199 | A1* | 8/2007 | Kurtz | E05C 17/042 248/352 |
| 2018/0238089 | A1 | 8/2018 | Duvall et al. | |
| 2021/0131154 | A1* | 5/2021 | Cunningham | E05C 17/12 |
| 2021/0164271 | A1* | 6/2021 | Williams | E05C 3/004 |

FOREIGN PATENT DOCUMENTS

KR 20060042736 A 5/2006

* cited by examiner

*Primary Examiner* — Christine M Mills
*Assistant Examiner* — Yahya Sidky
(74) *Attorney, Agent, or Firm* — Christopher G. Darrow; Darrow Mustafa PC

(57) ABSTRACT

A vehicle hood locking mechanism includes a locking member including a helical portion structured to be insertable into a cavity formed in a vehicle hood. The helical portion is structured to be rotatable with respect to the hood so that contact between the hood and the helical portion during insertion of the helical portion into the cavity causes a rotation of the helical portion from a first rotational position to a second rotational position different from the first rotational position. The locking mechanism is also structured so that the helical portion is rotatable from the second rotational position back to the first rotational position when the helical portion becomes positioned inside the cavity.

9 Claims, 4 Drawing Sheets

VEHICLE HOOD LOCKING MECHANISM

TECHNICAL FIELD

The present invention relates to mechanisms for holding a vehicle hood in an open condition and, more particularly, to a vehicle hood locking mechanism engageable to maintain a vehicle hood in a raised condition until positively disengaged by a user to enable lowering of the hood.

BACKGROUND

Devices for supporting a vehicle hood in a raised condition are known. However, many such devices may be inadvertently disengaged by vibration or movements of a user while working under the hood. Disengagement of the device may permit the hood to fall toward a closed condition, possibly injuring the user.

SUMMARY

In one aspect of the embodiments described herein, a vehicle hood locking mechanism includes a locking member including a helical portion structured to be insertable into a cavity formed in a vehicle hood. The helical portion is structured to be rotatable with respect to the hood so that contact between the hood and the helical portion during insertion of the helical portion into the cavity causes a rotation of the helical portion from a first rotational position to a second rotational position different from the first rotational position. The locking mechanism is also structured so that the helical portion is rotatable from the second rotational position back to the first rotational position when the helical portion becomes positioned inside the cavity.

BRIEF DESCRIPTION OF THE DRAWINGS

The accompanying drawings, which are incorporated in and constitute a part of this specification, illustrate embodiments described herein and together with the description serve to explain principles of embodiments described herein.

DETAILED DESCRIPTION

Figure 1:
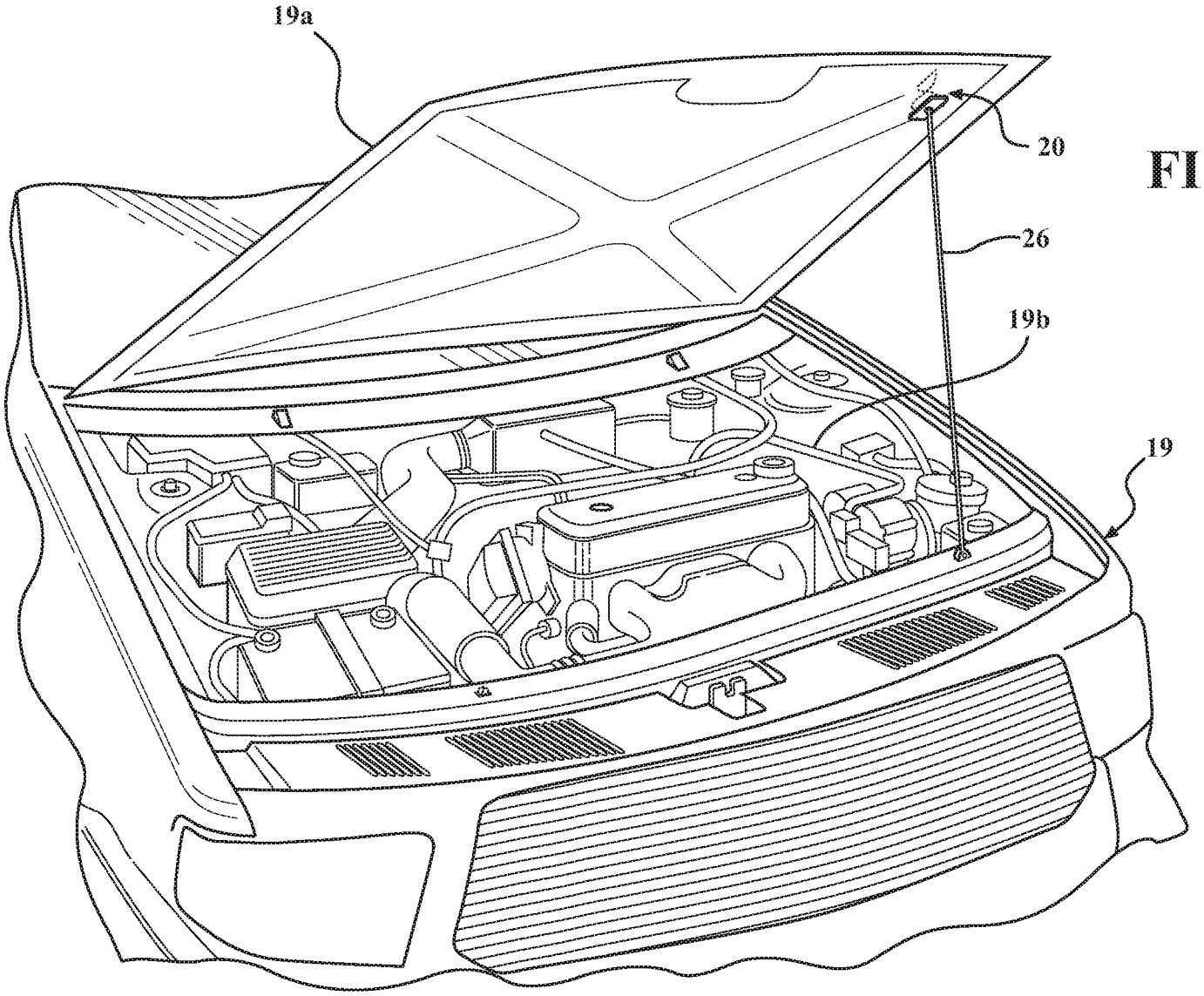
FIG. 1 is a schematic perspective view of a vehicle hood locking mechanism in accordance with an embodiment described herein, shown in a locked condition to support a raised vehicle hood.

Embodiments described herein relate to a vehicle hood locking mechanism including a helical portion structured to be insertable into a cavity formed in a vehicle hood. The helical portion is structured to be rotatable with respect to the hood so that contact between the hood and the helical portion during insertion of the helical portion into the cavity causes a rotation of the helical portion from a first rotational position to a second rotational position different from the first rotational position. The locking mechanism is structured so that the helical portion is rotatable from the second rotational position back to the first rotational position when the helical portion becomes positioned inside the cavity. When the helical portion rotates from the second rotational position back to the first rotational position, the helical portion is prevented from withdrawal from the hood cavity, thereby securing the helical portion within the hood cavity and securing the hood in a raised condition. To lower the hood, the helical portion may be rotated manually from the first rotational position to the second rotational position. While the helical portion resides in the second rotational position, the helical portion may be withdrawn from the cavity. This allows the hood locking mechanism to be rotated to a stowage position and permits the hood to be lowered.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. Unless otherwise noted, similar reference characters are used to describe similar features on separate elements and/or embodiments. Any of the components described herein may be formed from a material (or materials) suitable for the purpose(s) of the element as described herein.

FIGS. 1-4B illustrate the structure and operation of a vehicle hood locking mechanism (generally designated 20) in accordance with an embodiment described herein. The hood locking mechanism 20 may be operable to hold a vehicle hood 19*a* in a raised position as shown in FIG. 1 while a user accesses the vehicle engine compartment 19*b*. In one or more arrangements, the hood locking mechanism 20 may be mounted on (or may include) a rotatable stalk attached to the vehicle 19 under the vehicle hood 19*a*.

In one or more arrangements, the hood locking mechanism 20 may include a locking member 22 having a helical portion 22*a* structured to be insertable into a cavity 19*c* formed in a vehicle hood between an exterior panel 19*d* of the hood 19*a* (i.e., a panel facing outwardly away from the vehicle 19) and an interior panel 19*e* of the hood 19*a* (a panel facing, for example, in a direction toward the engine compartment 19*b* of the vehicle 19). The helical portion 22*a* may be inserted into the cavity 19*c* through an opening 19*f* formed in the hood interior panel 19*e*.

Figure 2A:
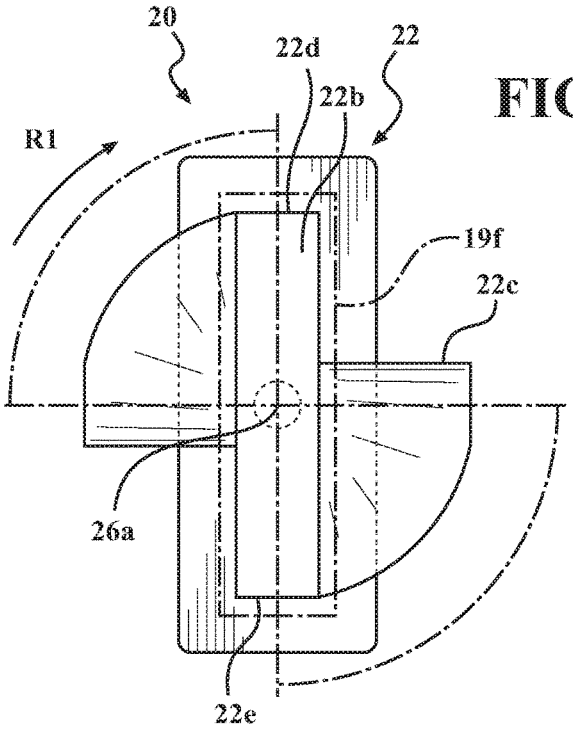
FIG. 2A is a schematic plan view of a helical portion of a vehicle hood locking mechanism in accordance with an embodiment described herein, showing the helical portion in a first rotational position.
Figure 2B:
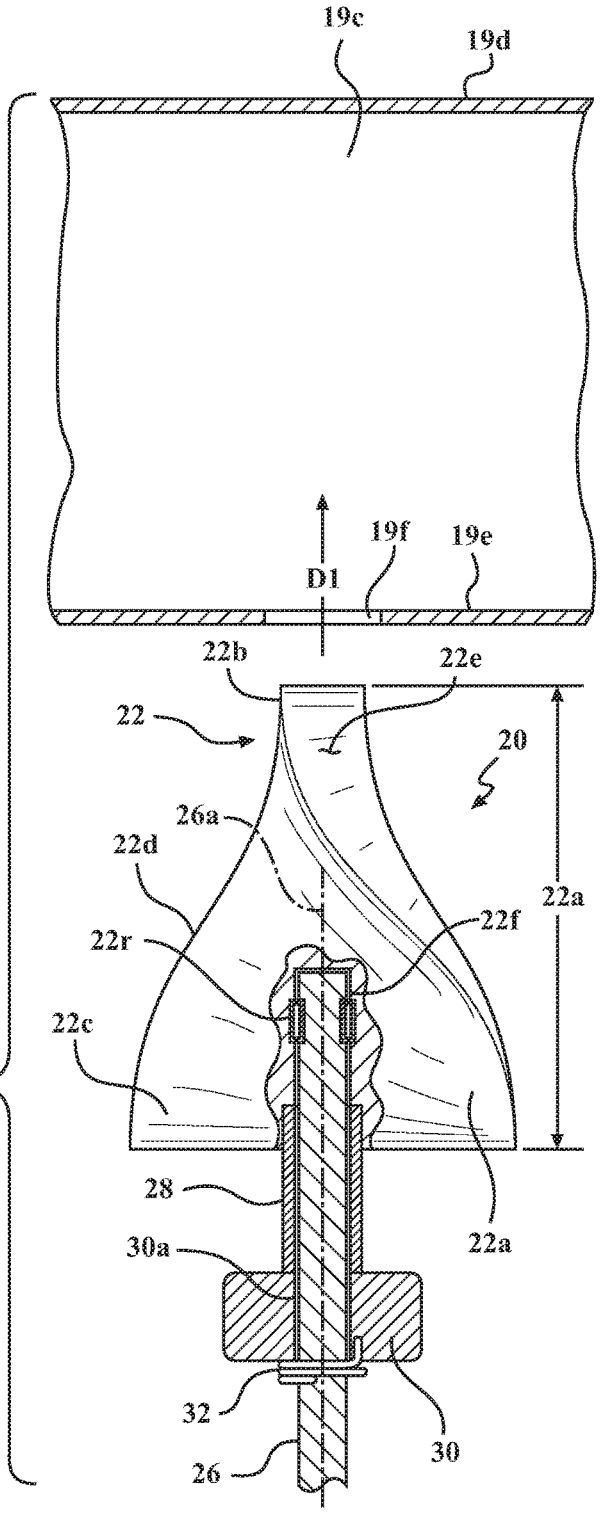
FIG. 2B is a schematic partial cross-sectional side view of the portion of the vehicle hood locking mechanism embodiment of FIG. 1A, shown prior to insertion of the helical portion through an opening in a vehicle hood and into a cavity formed in the vehicle hood.

As seen in FIGS. 2A and 2B, the helical portion 22*a* may have a first end 22*b* and a second end 22*c* opposite the first end 22*b*. Each side of opposite sides 22*d*, 22*e* of the helical portion 22*a* may helically wind or extend along a length of the helical portion 22*a* from the first end 22*b* toward the second end 22*c*, so that each of sides 22*d*, 22*e* at the second end 22*c* faces in a direction angularly spaced apart 90 degrees from the direction in which the side faces at the first end 22*b*. The helical structures of the opposite sides 22*d*, 22*e* have the combined effect of continuously and smoothly rotating the rectangular shape of the helical portion first end 22*b* through 90 degrees as the helical portion 22*a* is passed through the opening 19*f* as described herein.

The helical portion 22*a* may have a central interior cavity 22*f* structured to receive a portion of a mounting member 26 (described below) therein, thereby enabling rotatable mounting of the helical portion 22*a* on the mounting member 26. The central cavity 22*f* may also be structured to receive a portion of a connecting portion 28 (described below) therein, to enable an actuator portion 30 (described below) to be rotatably coupled to the helical portion 22*a* using the connecting portion 28.

The hood locking mechanism 20 may further include an actuator portion 30 spaced apart from the helical portion 22*a* and coupled to the helical portion so as to rotate with the helical portion. The actuator portion 30 may have a central cavity 30*a* structured to receive a portion of the mounting member 26 therein, thereby enabling rotational mounting of the actuator portion 30 to the mounting member 26.

In one or more arrangements, the actuator portion 30 may be connected to the helical portion 22*a* by a hollow connecting portion 28. The connecting portion 28 may be formed integrally with the actuator portion 30 (for example, by molding) or the connecting portion may be formed separately from the actuator portion 30 and attached to the actuator portion. The connecting portion 28 may be attached to the helical portion 22*a* by any suitable method (for example, adhesive attachment). When rotationally coupled to the helical portion 22*a* by the connecting portion 28, the actuator portion 30 may be structured to enable a user to rotate the helical portion 22*a* between first and second rotational positions of the helical portion (as described below) by manual rotation of the actuator portion 30.

The helical portion 22*a* and other elements of the hood locking mechanism 20 may be rotatably mounted to the mounting member 26 using any suitable method. In one example, referring to FIG. 2B, the mounting member 26 may extend into the helical portion cavity 22*f* and the helical portion 22*a* may be rotatably mounted on the mounting member 26 using a roller bearing 22*r* or other suitable rotational coupling element, so that the helical portion 22*a* and the connected actuator portion 30 may rotate together about the mounting member 26. In one or more arrangements, and as shown in the drawings, the mounting member 26 may be the rotatable stalk. In other arrangements, the mounting member 26 may be a member separate from the stalk and which is structured to be attachable to the stalk.

A spring member 32 may be coupled to the helical portion 22*a* and structured to exert a biasing force on the helical portion 22*a* tending to rotate the helical portion from the second rotational position to the first rotational position. In one or more arrangements, the spring member 32 may be a torsion spring member having a first free end connected to the mounting member 26 and a second free end attached to the actuator portion 30 so that a torsional force tending to rotate the helical portion 22*a* from the second rotational position to the first rotational position may be generated by rotating the helical portion 22*a* (using the actuator portion) from the first rotational position toward or to the second rotational position. In one or more arrangements, the helical portion 22*a* may be structured to automatically rotate from the second rotational position to the first rotational position responsive to the spring member biasing force, when the helical portion 22*a* becomes positioned inside the hood cavity 19*c* after insertion through the hood opening 19*f*.

FIG. 2A is a schematic plan view of the helical portion 22*a* showing the helical portion in the first rotational position relative to the mounting member 26. The mounting member 26 does not rotate about a longitudinal axis 26*a* of the mounting member. FIG. 2B is a schematic partial cross-sectional side view of the vehicle hood locking mechanism embodiment 20 of FIG. 2A, shown prior to insertion of the helical portion 22*a* through an opening 19*f* in a vehicle hood 19*a* and into a cavity 19*c* formed in the vehicle hood 19*a*.

The helical portion 22*a* may be rotatable about the mounting member 26 and with respect to the vehicle hood 19*a* so that contact between the hood 19*a* and the helical portion 22*a* during insertion of the helical portion 22*a* into the cavity 19*c* causes a rotation of the helical portion 22*a* from the first rotational position to a second rotational position different from the first rotational position. In addition, the locking mechanism 20 may be structured so that the helical portion 22*a* is rotatable from the second rotational position back to the first rotational position when the helical portion 22*a* becomes positioned inside the cavity 19*c*. In one or more arrangements, the helical portion may automatically rotate from the rotational position back to the first rotational position when the helical portion 22*a* becomes positioned inside the cavity 19*c*, due to a spring force exerted by the spring member 32 as described herein. The helical portion 22*a* is considered to be positioned inside the cavity 19*c* when the entire helical portion 22*a* resides inside the cavity (i.e., between the interior and exterior) following insertion into the cavity through opening 19*f*.

As seen in FIGS. 2A and 2B, a first end 22*b* of the helical portion 22*a* may be structured to be insertable into and through the opening 19*f* formed in the hood interior panel 19*e* leading into the cavity 19*c* when the helical portion 22*a* resides in the first rotational position. The first end 22*b* of the helical portion 22*a* may be inserted through the opening 19*f* (shown in phantom in FIG. 2A) formed in the hood interior panel, in direction D1. The hood opening 19*f* may be structured to include sides or edges spaced short distances apart from associated edges of the helical portion first end 22*b*. This enables the helical portion 22*a* to be inserted into the cavity 19*c* through the opening 19*f* while also ensuring that the helical portion 22*a* will rotate in a controlled manner due to contact between the opening edges and the helical portion 22*a* as the helical portion is inserted into the cavity through the opening 19*f*.

Figure 4A:
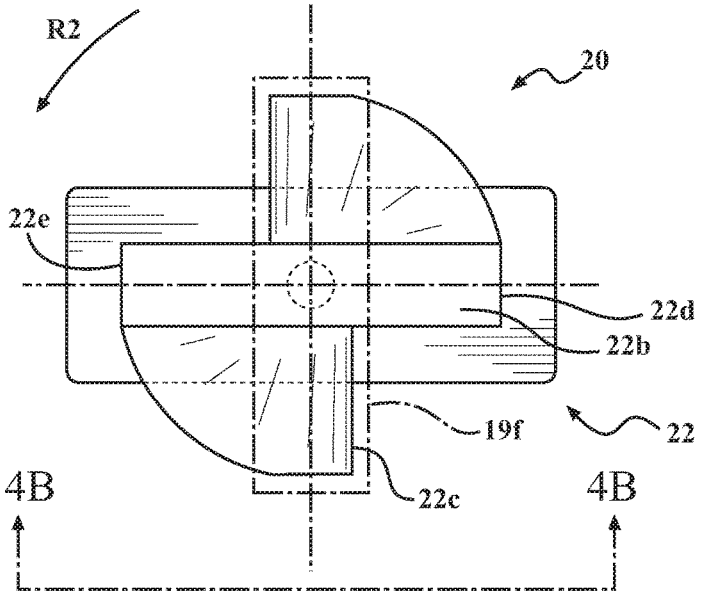
FIG. 4A is the schematic plan view of FIG. 2A showing the helical portion rotated to a second rotational position prior to withdrawal of the helical portion from the hood cavity through the opening in the hood.

As the helical portion 22*a* is gradually inserted into the cavity 19*c* through opening 19*f*, the edges of the non-rotating hood opening 19*f* may contact the sides of the helical portion 22*a*. Because the helical portion sides 22*d*, 22*e* wind helically along the length of the helical portion as previously described, this engagement between the sides of the hood opening 19*f* and the sides of the helical portion 22*a* produces a gradual rotation of the helical portion 22*a* (in direction R1 shown in FIG. 2A) from the first rotational position toward the second rotational position as the helical portion 22*a* proceeds into the cavity 19*c*. Just before the helical portion second end 22*c* enters the cavity 19*c*, the helical portion 22*a* has reached the second rotational position (an example of which is shown in FIG. 4A). When the helical portion second end 22*c* enters the cavity 19*c*, the helical portion 22*a* may automatically rotate back to the first rotational position responsive to the force exerted by spring member 32.

Figure 3:
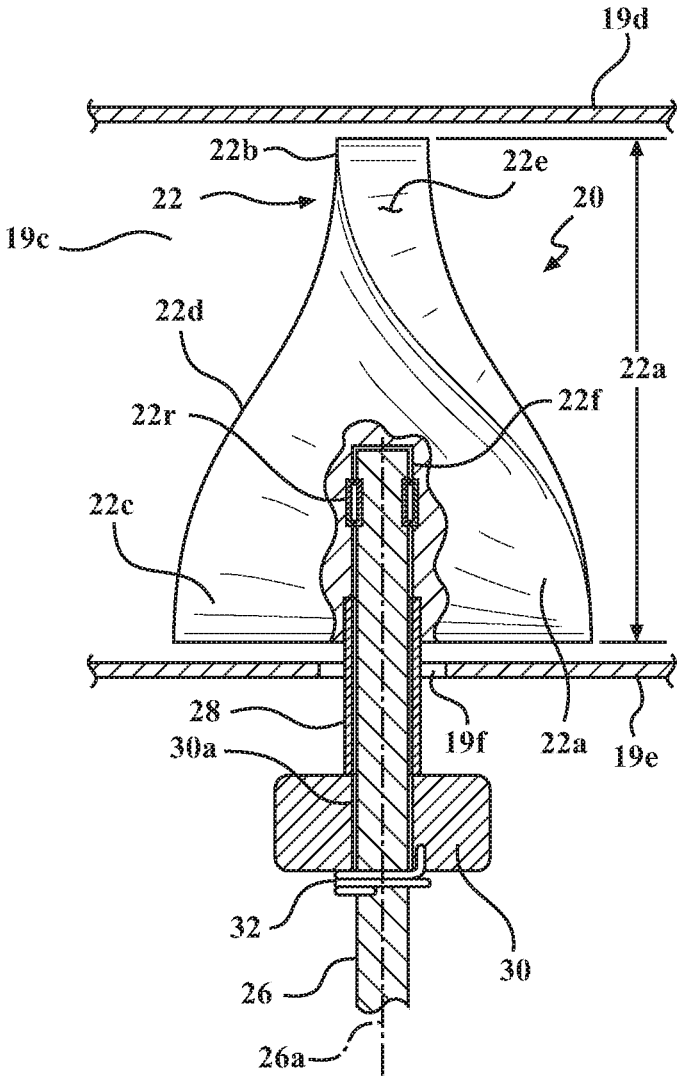
FIG. 3 is a partial cross-sectional schematic side view of the vehicle hood locking mechanism of FIGS. 2A and 2B, showing the helical portion after insertion completely through the vehicle hood opening and into the vehicle hood cavity.

FIG. 3 is a schematic partial cross-sectional side view of the vehicle hood locking mechanism 20 of FIG. 2A, showing the helical portion 22*a* after insertion completely through the vehicle hood opening 19*f* and into the vehicle hood cavity. This view shows the helical portion 22*a* returned to the first rotational position shown in FIGS. 2A and 2B. As seen in FIGS. 2A and 3, when the helical portion 22*a* is in the first rotational position, the sides 22*d*, 22*e* of the helical portion 22*a* at the second end 22*c* are out of alignment with the shape of the hood opening 19*f*. Thus, the helical portion 22*a* is prevented from being withdrawn from the cavity 19*c* through the hood opening 19*f* when the helical portion 22*a* is in the first rotational position, thereby preventing the hood 19*a* from becoming detached from the hood locking mechanism 20. In addition, the hood interior panel 19*e* may be rested on the actuator portion 30 to prevent the hood 19*a* from falling downwardly.

Figure 4B:
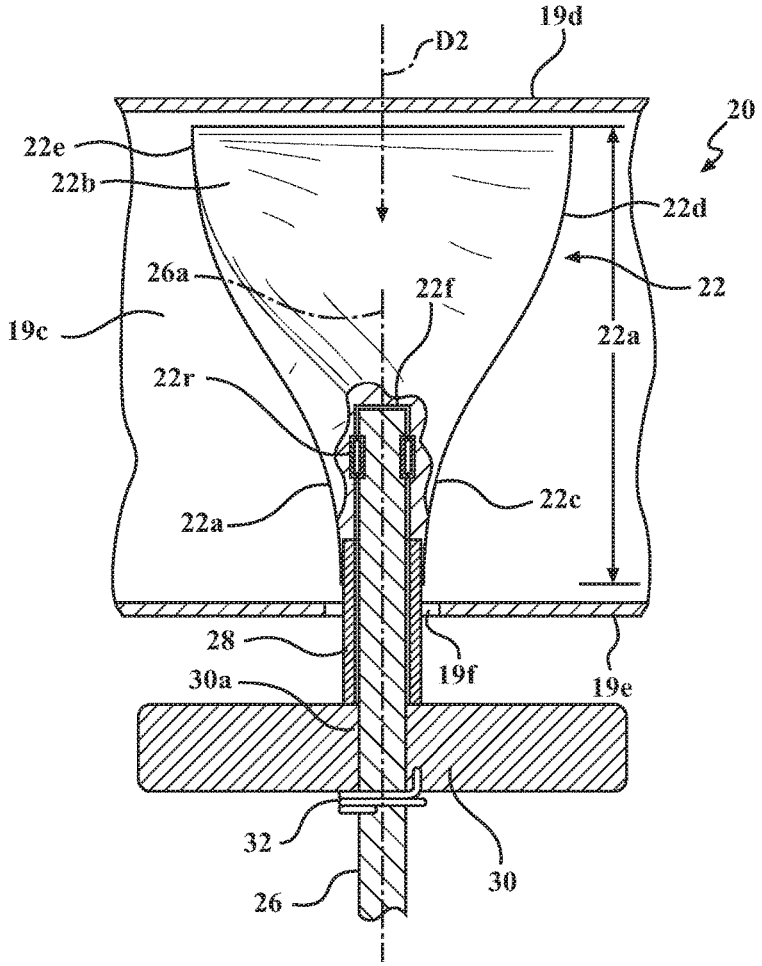
FIG. 4B is a schematic partial cross-sectional side view of the helical portion rotated to the second rotational position as shown in FIG. 4A, and prior to insertion of the helical portion into the hood opening to withdraw the helical portion from the hood cavity.

To withdraw the helical portion 22*a* from the hood cavity 19*c*, actuator portion 30 may be manually rotated (against the biasing force exerted by spring member 32) to the second rotational positon as shown in FIGS. 4A and 4B. In this orientation, it may be seen that the second end 22*c* of the helical portion 22*a* may be inserted in direction D2 (opposite direction D1) into the hood opening 19*f* when the helical portion 22*a* is in the second rotational positon. As the helical portion 22*a* moves through the opening 19*f* in direction D2, engagement between the edges of opening 19*f* and the sides 22*d*, 22*e* of the helical portion 22*a* acts to rotate the helical portion in direction R2 (opposite direction R1) from the second rotational position toward the first rotational position. When the helical portion 22*a* reaches the first rotational position, the helical portion first end 22*b* aligns with the shape of the opening 19*f* and the helical portion 22*a* may be withdrawn completely from the cavity 19*c*, thereby disengaging the hood locking mechanism 20 from the hood 19*a*.

In the above detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A vehicle hood locking mechanism comprising a locking member including a helical portion structured to be insertable into a cavity formed in a vehicle hood, the helical portion being structured to be rotatable with respect to the vehicle hood so that contact between the vehicle hood and the helical portion during insertion of the helical portion into the cavity causes a rotation of the helical portion from a first rotational position to a second rotational position different from the first rotational position, and wherein the vehicle hood locking mechanism is structured so that the helical portion automatically rotates from the second rotational position back to the first rotational position as soon as the helical portion becomes positioned inside the cavity, wherein the helical portion is structured to be insertable into an opening into the cavity in a first direction when the helical portion is in the first rotational position, and wherein the helical portion is structured to be insertable into the opening in a second direction opposite the first direction when the helical portion is in the second rotational position.

2. The vehicle hood locking mechanism of claim 1 wherein the cavity is formed between an interior panel of the vehicle hood and an exterior panel of the vehicle hood, and wherein the opening is formed in the interior panel.

3. The vehicle hood locking mechanism of claim 2 wherein a first end of the helical portion is structured to be insertable into the opening when the helical portion is in the first rotational position.

4. The vehicle hood locking mechanism of claim 3 wherein a second end of the helical portion opposite the first end is structured to be insertable into the opening when the helical portion is in the second rotational position.

5. The vehicle hood locking mechanism of claim 1 further comprising a spring member coupled to the helical portion and structured to exert a biasing force on the helical portion tending to rotate the helical portion from the second rotational position to the first rotational position, and wherein the helical portion is structured to automatically rotate from the second rotational position to the first rotational position responsive to the biasing force, when the helical portion becomes positioned inside the cavity.

6. The vehicle hood locking mechanism of claim 1 further comprising an actuator portion spaced apart from the helical portion and coupled to the helical portion so as to rotate with the helical portion, wherein the actuator portion is structured to enable a user to rotate the helical portion from the first rotational position to the second rotational position by rotating the actuator portion against a biasing force exerted by a spring member.

7. A vehicle including a vehicle hood locking mechanism in accordance with claim 1.

8. A vehicle hood locking mechanism comprising a locking member including a helical portion structured to be insertable into a cavity formed in a vehicle hood, the helical portion being structured to be rotatable with respect to the vehicle hood so that contact between the vehicle hood and the helical portion during insertion of the helical portion into the cavity causes a rotation of the helical portion from a first rotational position to a second rotational position different from the first rotational position, wherein the vehicle hood locking mechanism is structured so that the helical portion is rotatable from the second rotational position back to the first rotational position when the helical portion becomes positioned inside the cavity, the vehicle hood locking mechanism further comprising a spring member coupled to the helical portion and structured to exert a biasing force on the helical portion tending to rotate the helical portion from the second rotational position to the first rotational position, and wherein the helical portion is structured to automatically rotate from the second rotational position to the first rotational position responsive to the biasing force, when the helical portion becomes positioned inside the cavity.

9. A vehicle hood locking mechanism comprising a locking member including a helical portion structured to be insertable into a cavity formed in a vehicle hood, the helical portion being structured to be rotatable with respect to the vehicle hood so that contact between the vehicle hood and the helical portion during insertion of the helical portion into the cavity causes a rotation of the helical portion from a first rotational position to a second rotational position different from the first rotational position, wherein the vehicle hood locking mechanism is structured so that the helical portion is rotatable from the second rotational position back to the first rotational position when the helical portion becomes positioned inside the cavity, the vehicle hood locking mechanism further comprising an actuator portion spaced apart from the helical portion and coupled to the helical portion so as to rotate with the helical portion, wherein the actuator portion is structured to enable a user to rotate the helical portion from the first rotational position to the second rotational position by rotating the actuator portion against a biasing force exerted by a spring member.

* * * * *